United States Patent [19]

Traise

[11] 4,050,361

[45] Sept. 27, 1977

[54] PLOW FOLDING AND HEAT SEALER APPARATUS FOR CONTINUOUS BUSINESS FORMS

[75] Inventor: John E. Traise, Niagara Falls, N.Y.

[73] Assignee: Moore Business Forms, Inc., Niagara Falls, N.Y.

[21] Appl. No.: 760,020

[22] Filed: Jan. 17, 1977

Related U.S. Application Data

[63] Continuation-in-part of Ser. No. 653,882, Jan. 30, 1976, abandoned.

[51] Int. Cl.[2] ..... B31B 23/00

[52] U.S. Cl. ..... 93/1 F; 93/63 R; 93/DIG. 1; 156/495; 156/583; 198/813; 226/90; 226/195

[58] Field of Search ..... 93/1 F, 20, DIG. 1, 93/63 R, 63 M, 61 R, 84 R, 8 R; 226/195, 90, 91; 198/813; 270/37; 156/495, 494, 583

[56] References Cited

U.S. PATENT DOCUMENTS

| | | | |
|---|---|---|---|
| 2,213,602 | 9/1940 | Yates | 93/63 M X |
| 2,847,915 | 8/1958 | Rapp | 93/63 M X |
| 2,910,723 | 11/1959 | Traver | 18/1 |
| 2,993,523 | 7/1961 | Monaco et al. | 156/495 X |
| 3,016,085 | 1/1962 | Gassner | 156/359 |
| 3,286,077 | 11/1966 | Radford et al. | 156/583 |
| 3,356,557 | 12/1967 | Enskat | 156/495 X |
| 3,844,090 | 10/1974 | Pepmeier | 93/20 X |
| 3,955,737 | 5/1976 | Traise | 226/195 X |
| 4,002,519 | 1/1977 | Moseley et al. | 156/583 X |

*Primary Examiner*—James F. Coan

[57] ABSTRACT

An apparatus to effect longitudinal plow folding and subsequent heat sealing of previously computer printed continuous business forms stationary includes a folder and a plurality of elongated heating ribbons disposed parallel to the direction of web travel in spaced apart parallel relationship and being convexly curved for supporting the continuous web passing thereover. Hot melt adhesive applied during manufacture of the stationary is disposed between the plies of the folded-over web, to be locally heated through the web as it lays against, and advances directly over, the multiplicity of parallel heating ribbons. Upon exiting the heater bed, a sandwich platen is provided to maintain the plies in intimate contact, while removing heat from the web and adhesive to bond the plies at each of the multiplicity of spots so heated. The folded and sealed web may then be processed by conventional bursting into individual sealed documents, for mail processing or confidential distribution.

12 Claims, 5 Drawing Figures

PLOW FOLDING AND HEAT SEALER APPARATUS FOR CONTINUOUS BUSINESS FORMS

RELATED APPLICATION

This application is a continuation-in-part of U.S. Ser. No. 653,882, filed Jan. 30, 1976, and now abandoned.

BACKGROUND OF THE INVENTION

This invention relates generally to a heat sealer apparatus, and more particularly to such an apparatus for the localized heating of hot melt adhesive between folded superimposed plies of a continuous business form.

In preparation of certain constructions of business forms, such as confidential checks or media acceptable for mail processing, it has been the general industry practice to handle this as a two or three step process involving collating and envelope inserting. Previous attempts in preparing this product in one step following computer printout of the continuous web using adhesives around the inside face perimeter of a plow-folded web have met with only limited success due to the adhesive application difficulties or, with heat activated types of adhesives, due to the high thermal input necessary to raise the entire web and adhesive temperature to effect sealing, and the resultant web distortions initiated thereupon as a result of this high energy input, due to moisture imbalance created between the web and ambient air, in addition to general difficulties attendant to processing the web through a heating tunnel platen.

SUMMARY AND OBJECTIVE OF THE INVENTION

It is an object of this invention to provide an improved thermal sealer which is energy-efficient and which is capable of processing a large variety of this type of document, using a plurality of low-mass, longitudinal and parallel-disposed, electric-resistance heating ribbons in a generally arcuate convex affixment, over which the web of plow-folded continuous stationery is drawn, to effect a multiplicity of localized spots of sealing between the plow-folded faces, which individually and collectively are sufficiently small that moisture unbalance in the heated area is restored quickly upon re-exposure to ambient air conditions, but which are collectively of sufficient are to effect a fully enclosed document acceptable as a confidential form or for mail processing over sorting and cancelling machinery currently in postal use.

It is a further object of this invention to provide a self-threading plow folder integral to the device which will accept a flat web of continuous stationery previously imaged on a computer printer, folding the web continuously along a centerline of weakened perforation on the web and forwardly processing the folded web into the arcuate heating means.

It is a further object of the invention to provide a sealing platen following the arcuate heating means to effect chilling and sealing of the hot melt adhesive, thus producing a continuous web of folded and selaed stationery ready for entrance into a conventional forms burster for separation into individual documents. The burster could be integrally affixed to the sealer or could be operationally separate from it.

It is a further object of the invention to provide variable heat control means whereby the energy introduced in the parallel bands of heating ribbons may be varied from a quiescent holding level to any higher level as dictated by the speed of web travel, and transferred to the web of stationery being processed over the heating platen and heating ribbon means, in immediate response to changes in web speed, such that actual unit temperature of the heated adhesive spot areas on the web of stationery remains relatively steady over the speed variation. Further, the maximum voltage on the heater ribbons is sufficiently limited that no electrical or personal hazard exists which would preclude the use of the arcuate heating ribbons in open configuration, thus permitting not only the most rapid thermal response characteristics to changes in the operating, speed, and accordingly voltage changes, but also permits construction of a relatively simple, low cost configuration. Such configuration is moderate in energy consumption and minimizes excess energy radiation to surrounding environment which results in an efficient piece of forms processing equipment, which can be utilized without the need of special electrical, ventilation or installation requirements.

These and other novel features of the invention will become apparent from the following detailed description of the invention.

DESCRIPTION OF THE INVENTION

Figure 1:
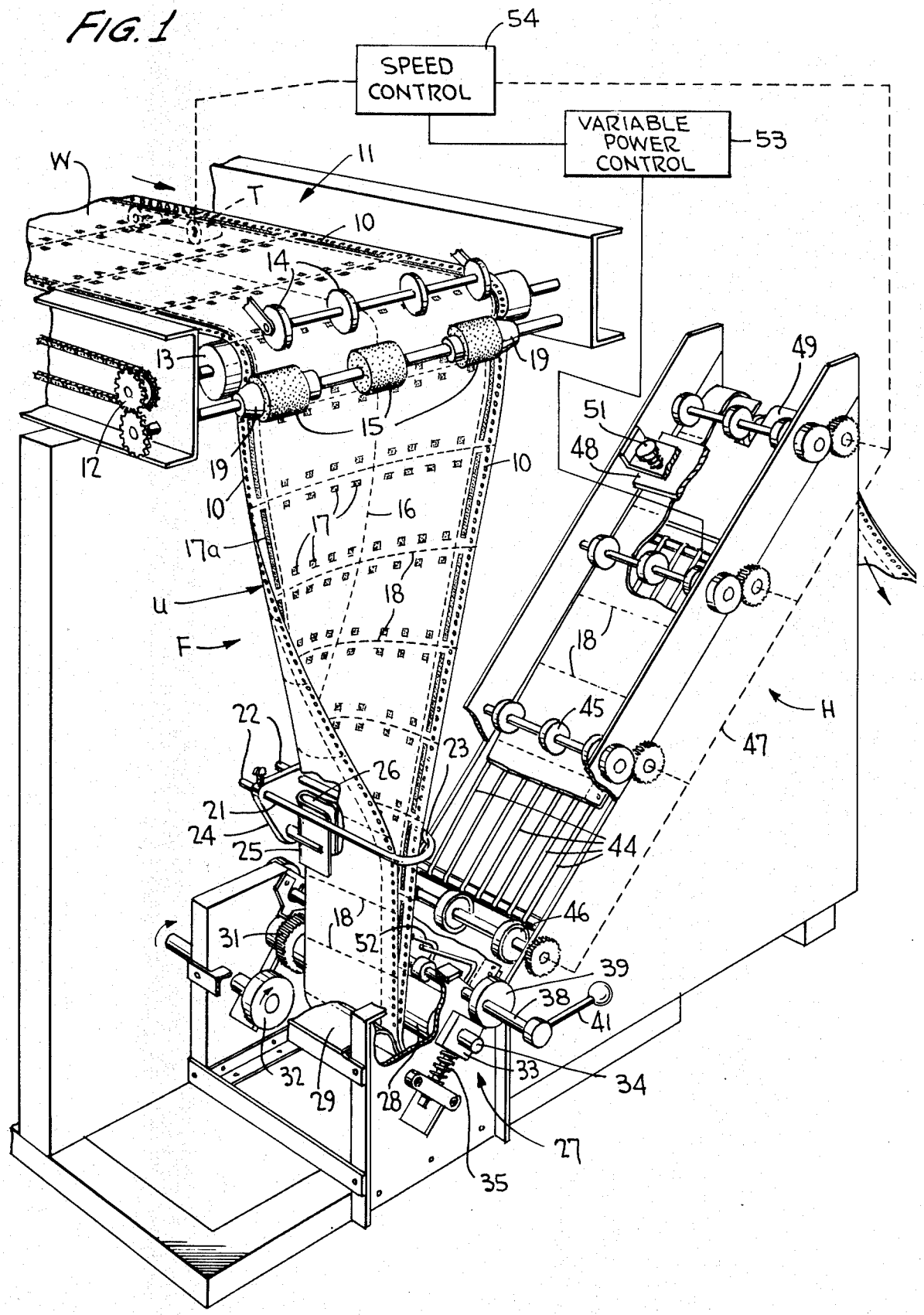
FIG. 1 is a perspective view of the apparatus showing the plow folding and heat sealing features of the invention.

Turning now to the drawings wherein like reference characters refer to like and corresponding parts throughout the several views, a continuous business form or web W is shown in its flat condition as it is fed in the direction of the arrow by means of a conventional tractor pin feed device T having the usual feed pins engaging spaced holes 10 formed along a margin of the web. Only one of such devices T is shown in FIG. 1, although it should be recognized that a pair of such devices are normally provided for engagement with spaced holes 10 provided along opposite marginal edges of the web.

Pin feed tractor devices T are provided at a printing station generally designated 11 at which the web may be imprinted in a normal manner as by means of a synchronously coupled print unit (not shown). Drive means 12 are synchronized with the tractor pin feed devices for driving roll 13 over which the web is moved beneath a plurality of holddown rolls 14. Another set of rolls 15 are in rolling contact with drive roll 13. The nature and purpose of these rolls 15 will be more fully described hereinafter.

The apparatus according to the invention is designed to continuously fold the web as it moves in the direction of the arrow along its longitudinal line 16 of weakening. Adhesive such as spots 17 and lines **17*a* are provided on the undersurface of the web for each unit U to be burst from the web after the folding and heat sealing operation is completed. Adhesive 17 is of the hot melt variety which becomes tacky upon the application of heat and which sets up when cooled. Also, it should be pointed out that the web is provided with spaced transverse lines 18 of weakening for thereby delimiting each of the series connected units U which will ultimately be burst apart. Thus, as the web is folded progressively and continuously at the folding station F, it must be maintained at a relatively low tension so as not to prematurely sever transverse lines 18 of weakening. Also, rolls 15 have been designed as cushion rolls with the end ones having conical portions 19** tapering outwardly toward opposite edges of the web so as to accommodate the tendency of the web to inwardly curl while the web is in the process of being folded.

Such a folding is effected by a folding means which comprises a U-shaped rod 21 having spaced legs 22 between which the folds of the web pass. The rounded bight portion 23 for the legs is disposed adjacent the free edges of the web so as to smoothly converge these edges together. Also, base plate 24, carrying paper guide shoe 25, is axially adjustable on said U-shaped rod 21 to accommodate various form widths of the web.

The folding means further comprise a paper guide shoe 25 mounted on base plate 24 and having a flared opening 26 at the upper end of the spaced side walls thereof. The side walls are, of course, open at their inner end and, as the folded web passes therebetween, the web is creased along its longitudinal fold line 16.

Figure 2:
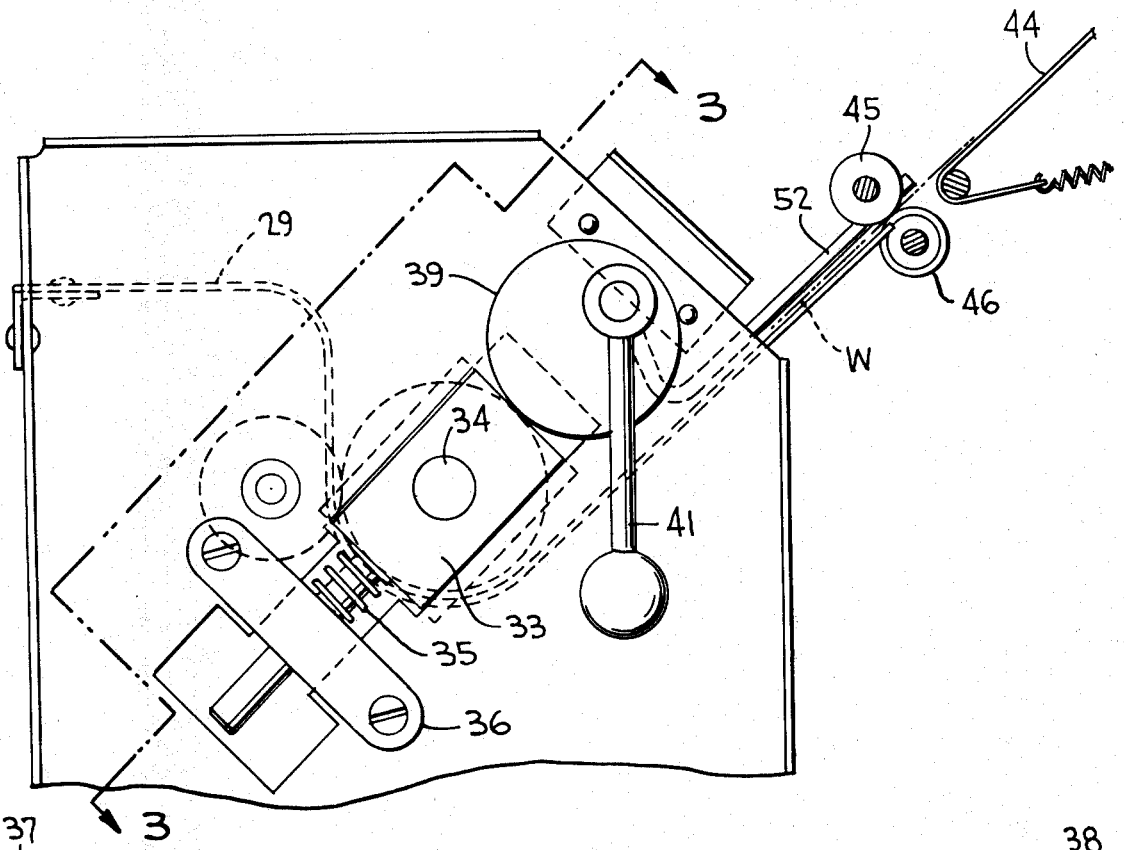
FIG. 2 is a side elevational view showing the details of the combined drive and snubbing roll of the FIG. 1 apparatus during the webbing-up operation, although the web is not shown for the purpose of clarity.
Figure 3:
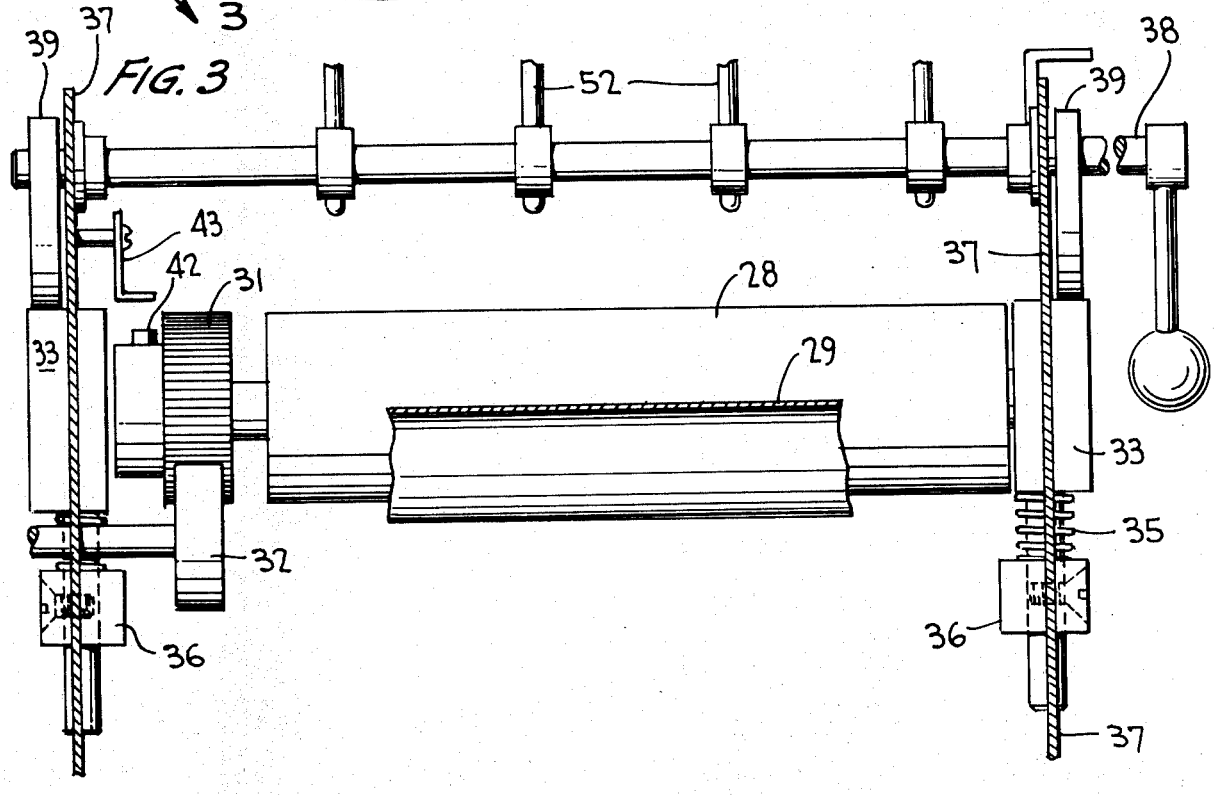
FIG. 3 is a top plan view taken substantially along line 3—3 of FIG. 2.
Figure 4:
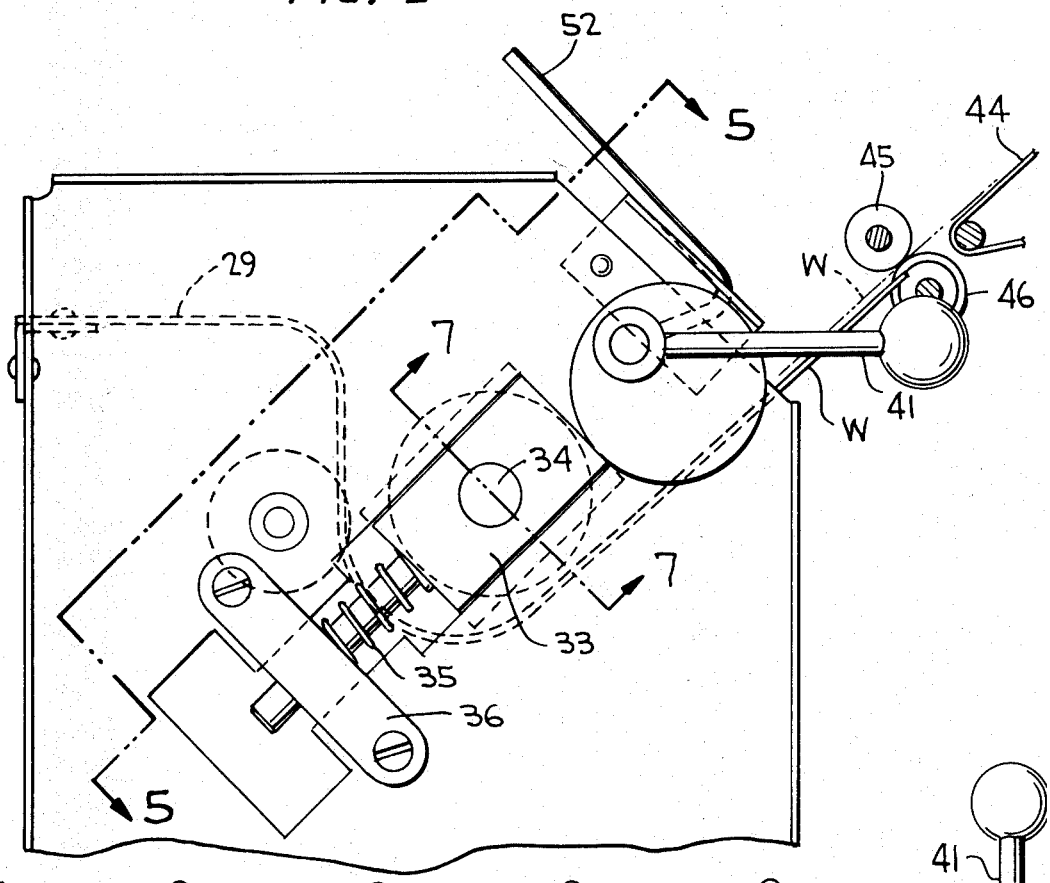
FIG. 4 is a view similar to FIG. 2 showing the apparatus in a web running condition.
Figure 5:
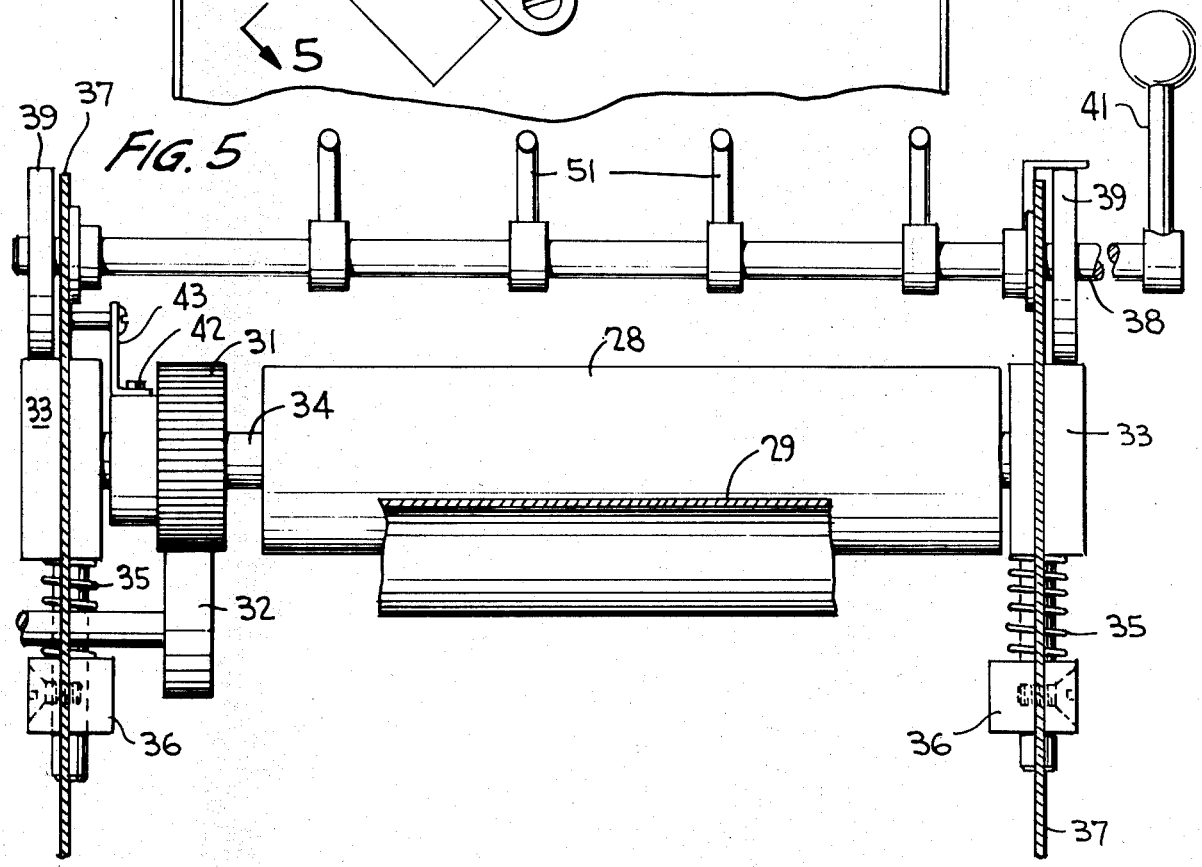
FIG. 5 is a plan view of the device of FIG. 4 taken substantially along the line 5—5 thereof.

Downstream of the folding station is a combination web drive and snubber means generally designated 27. Such a means includes a turn roll 28 and a curved backup plate 29. Roll 28 is provided at one end of its axle 34 with a roll 31 having a friction surface for rolling engagement with a drive wheel 32 which is rotated in any conventional manner at approximately the same displacement as that of tractor T. Roll 28 is mounted for movement toward and away from its backup plate and is provided with a bearing block 33 on its axle 34. As will be seen more clearly in FIGS. 2 to 5, bearing blocks are provided at opposite ends of shaft 34 and are urged away from backup plate 29 by means of coil springs 35 which bear against flanges 36 secured to frame plates 37 of the apparatus. A shaft 38 spans frame plates 37 and has cam plates 39 at opposite ends thereof in bearing contact with blocks 33. A radially extending handle 41 is secured to rod 38 so that, upon manual movement of handle 41, causing shaft 38 to rotate, cam plates 39 are rotated so as to shift roll 28 downwardly into a pressure engagement with its drive roll 32 as shown in FIG. 2. In such condition roll 31 is moved into engagement with drive wheel 32 so as to effect roll movement of roll 28 during the initial webbing-up operation of the apparatus. In other words, in setting up the apparatus for plow folding and subsequent heat sealing, the operator manually folds the free end of the web about its centerline and threads it through legs 22 of bar 21 and thereafter moves handle 41 so as to bring roll 28 into pressure contact with its drive roll as in FIG. 2. The leading edge of the then folded form is now threaded around roll 28 and backup plate 29 so as to permit it to be automatically fed further downstream toward heat sealing station H.

Roll 28 is also arranged to effect a snubbing action whereupon its rotation is arrested as by means of a radially extending pawl or stop pin 42 thereon engaging a stop plate 43 secured to a frame plate 37 of the apparatus. Hence, upon rotation of handle 41 to a position permitting roll 28 to be urged away from its backup plate under the assistance of springs 35 (FIG. 4), pawl 42 will, upon some slight turn of roll 28, be brought into bearing engagement with stop plate 43 (FIG. 5) so as to prevent further rotation of roll 28. This roll then serves as a snubber for the purpose to be more clearly seen hereinafter.

Heat sealing station H comprises a plurality of heating ribbons 44 spaced apart and extending longitudinally in the direction of feed of the web through the apparatus. The heating elements or ribbons may be of Nichrome or other suitable electrical resistance material, and are mounted on supports having low specific heat constants such as phenolic resin or ceramic which are electrically non-conductive. No other support or guide plates are provided beneath or above the heating ribbons so that they are completely exposed to avoid any heat dissipation therefrom. Also, the heating ribbons are slightly convexly chordally affixed between their ends as can be seen from a close inspection of FIG. 1.

Feed means are provided for the folded web by means of four pairs of cooperating upper and lower rolls 45 and 46. One of each roll pair is driven as by means of a chain drive schematically shown at 47 in FIG. 1, and the drive thereof (not shown) is coupled to the drive of tractor pin feed devices T, as shown schematically in dashed lines. However, some suitable reduction gear means or the like is provided for causing the drive wheels or feed roll pairs 45 and 46 to be rotated at a slightly faster rate of speed as compared to the drive rate of the tractor pin feed devices. A higher tension is therefore effected for the folded over and sealed web at heat sealing station H as compared to the web being folded at folding station F. Such high tension is needed in order to avoid any crimping or misalignment in portions of the folded-over web while its folds are being heat sealed together.

The heat sealing station further includes upper and lower platens 48 and 49 disposed at the downstream end of the heating ribbon and having a sufficient width in the direction of the feed through the apparatus as to dissipate the heat from the web and the adhesive so as to sufficiently cool it in readiness for bursting of units U from the web as the web is fed into a burster (not shown) which would be typically disposed at the downstream end of the present device. Top platen 48 is capable of being moved adjustably downwardly by a turn screw 51.

It should be further pointed out that a plurality of spaced hold-down fingers 52 are provided along rod 38 so that, in the webbing-up condition of the web as shown in FIG. 2, these fingers are moved downwardly as shown to insure that the initially fed web is fed into the nip between the first set of feed rolls 45 and 46. In the running condition of the machine, however, fingers 52 are moved into their position of FIG. 4 upon rotation of handle 41 since they are not needed now that feed rolls 45, 46 have taken over to properly feed the web at heat sealing station H.

In summary, during the initial webbing-up operation, a leading end of the web will be manually folded along its centerline and threaded between the legs of bar 21 and, after roll 28 is moved into pressure contact with its backup plate, this leading edge will be also threaded therethrough so as to be propelled via drive wheel 32 until it reaches the nip of the first set of drive wheels 45, 46 at the heating station. At this position, fingers 52 are in a down position of FIG. 2 so as to insure that the leading edge of the web will be promptly directed toward the nip of the first set of feed rolls. Thereafter, roll 28 is manually moved away from its backup plate to the position shown in FIGS. 1 and 4 so that its roll 31 is now no longer in engagement with drive wheel 32. This shifting movement of roll 28 is, of course, effected by manually moving bar 41 so as to rotate rod 38 and accordingly move fingers 52 away from the web. Slight rotation of roll 28 by the web in engagement therewith moves pawl 42 in contact with stop 43 so as to prevent further rotation of the roll. Roll 28 therefore is converted into a snubbing roll and serves to isolate the higher web tension at the heat sealing station from the lower tension at the folding station in magnitude determined by capstan force equation $F_2/F_1 = e^f$ where tension isolation ratio $F_2/F_1$ is determined by the coefficient of friction between the web W and the snubbing roll surface 28 and the angle of wrap in radians. Accordingly, the higher tension is thusly reduced in the tractor pin feed area. The lower tension of the web at the folding station is therefore assured for preventing any premature separation of web sections along transverse lines 18 of weakening.

As the folded web is fed by the first three pairs of feed rolls 45 and 46 shown in FIG. 1, it is thereby made to lie directly against the heating ribbons, further assisted by the convexly affixed heating ribbons, for heating adhesive spots 17 and streams 17*a* as the web itself is heated. A variable power control system 53 for the heating elements may be operatively coupled with speed control 54 of the drive mechanism of the apparatus, in such a manner as to increase/decrease power input for the heating element in accordance with increase/decrease in web speed.

From the foregoing, it can be seen that a simple and economical yet highly effective web folding and heat sealer apparatus has been devised for continuous business forms. Cushioned rolls with coned ends support the web under stress in the forming fold by permitting the opposite edges of a web to naturally curl while in the process of being continuously folded along the centerline of the form. The U-shaped or trombone rod supports the open edges of the web at the downstream end of the formed fold, and the combined snubbing and feeding roll effects a unique transition from the folder to the sealing station which serves to self-feed the form when webbing-up, such roll then engaging a stop pawl when the web is fed into the sealer drive rolls to thereby serve as a snubbing roll to reduce web tension at the folding station. The sealer is equipped with low-mass parallel disposed heating ribbons which are energy responsive to changes in machine speed from a quiescent holding level when the web is stationary and permitting maximum energy when at full speed. Moreover, the sealing platens seal and press the form together at the downstream end of the heating station.

Obviously, many modifications and variations of the invention are made possible in the light of the above teachings. It is therefore to be understood that within the scope of the appended claims the invention may be practiced otherwise than as specifically described.

What is claimed is:

1. An apparatus for effecting plow folding and subsequent heat sealing of a continuous web, comprising, a plow folding station for effecting a longitudinal folding of the web about a longitudinal line of weakening thereof, a heat sealing station for effecting a sealing together of the folded-over portions of the web as hot-melt adhesive disposed between the portions is melted by heating, first means for feeding the web in a flat and unfolded condition at a first rate of speed into said plow folding station, second means at said heat sealing station for feeding the folded and sealed web outwardly of the apparatus at a second rate of speed faster than said first rate to thereby tension the web at said heat sealing station to a greater extent than at said folding station, and a combined wb drive and snubber roll means disposed between said stations for initially feeding the folded web into said second feed means at said heat sealing station and for subsequently snubbing the web, whereby the higher tensioned web at said heat sealing station is isolated from the lesser tensioned web at said folding station, said web drive and snubber roll means including a roll mounted for movement between a drive and a snubbing position.

2. The apparatus according to claim 1, wherein said roll has a radially extending pawl thereon engageable with a stop member provided on the apparatus so as to arrest rolling movement of said roll when in said snubbing position.

3. The apparatus according to claim 1, wherein said heat sealing station includes a plurality of spaced heating ribbons disposed longitudinally of the form and being convexly affixed between opposite ends thereof.

4. The apparatus according to claim 1, wherein said folding station includes a substantially U-shaped rod for converging opposing edges of the web into overlying relationship as the web passes between the legs of said rod.

5. The apparatus according to claim 4, wherein said folding station further includes a funnel-shaped plate disposed at one end of said rod for the reception of a folded web portion opposite said edges.

6. The apparatus according to claim 3, wherein said folding station further includes a pair of platens of predetermined width for contacting opposite sides of the folded and sealed web and being disposed outwardly of an end of said ribbons for dissipating the heat from said web and the adhesive before exiting said apparatus.

7. The apparatus according to claim 1, wherein roll means are provided between said first feed means and said folding station for effecting a smooth transition of the web between its flat and folded condition, said roll means including a plurality of cushion rolls with a pair thereof being disposed adjacent opposite edges of the form and having conical ends to accommodate web curl as the web is being folded.

8. An apparatus for effecting plow folding and subsequent heat sealing of a continuous web, comprising, means for continuously folding opposing edges of the web into overlying relationship from a flat condition of the web as it moves through the apparatus, heat sealing means downstream of said folding means for sealing folded-over portions of the web together as hot-melt adhesive disposed between the portions is melted by heating, first means for feeding said web into said fold means at a first rate of speed, second means for feeding said folded web at said heat sealing means at a rate faster than said first rate to thereby increase web tension at said sealing means as compared to that at said folding means, a combined drive and snub roll means disposed between said folding means and said sealing means for initially feeding the web into said second feed means and for subsequently snubbing the web for isolating the increased web tension at said sealing means from the web tension at the folding means.

9. The apparatus according to claim 8, wherein said combined means includes a roll drive element, a roll mounted for movement into and out of engagement with said element, a backup element for said roll providing a squeeze for the web when said roll is engaged with said drive element, and a radially extending pawl on said roll disposed for engagement with a stop element on the apparatus when said roll is out of engagement with said drive element to thereby arrest rotation of said roll and render it a snubber.

10. The apparatus according to claim 8, wherein said sealing means includes a plurality of spaced heating ribbons disposed along the direction of web movement through the apparatus, and a pair of platens having a predetermined width in said direction and disposed for contact with opposite sides of the web at the downstream end of said ribbons, whereby to dissipate heat from the web and the adhesive before the web exits the apparatus.

11. The apparatus according to claim 8, wherein said folding means includes a U-shaped rod arranged for smoothly converging the web into its folded position as it passes between the legs thereof, and a funnel-shaped fold plate disposed adjacent said rod through which a crease of the folded web is designed to pass.

12. The apparatus according to claim 8, wherein roll means are provided upstream of said fold means to facilitate a smooth transition of the web between a flat and folded condition thereof, said roll means including at least a pair of cushion rolls disposed adjacent opposite edges of the web, said cushion rolls being conical and respectively tapering toward said edges to accommodate for web curl as the web commences to be folded.

* * * * *